US005100039A

United States Patent [19]

Kingston

[11] Patent Number: 5,100,039

[45] Date of Patent: Mar. 31, 1992

[54] CURLED DOCUMENT MANAGEMENT DEVICE

[76] Inventor: Kevin J. Kingston, 50-D 5th Ave., Santa Cruz, Calif. 95062

[21] Appl. No.: 522,057

[22] Filed: May 8, 1990

[51] Int. Cl.[5] ..... B26F 3/02

[52] U.S. Cl. ..... 225/93; 225/91

[58] Field of Search ..... 225/93, 81, 82, 27, 225/28, 91; 248/504

[56] References Cited

U.S. PATENT DOCUMENTS

| | | | |
|---|---|---|---|
| 405,781 | 6/1889 | Kretzer | 225/91 |
| 1,153,503 | 9/1915 | Kuhmarker | 225/27 |
| 1,218,670 | 3/1917 | Kramer | 225/91 |
| 1,823,278 | 9/1931 | Martin | 248/504 |
| 1,903,173 | 3/1933 | Euth | 225/91 |
| 2,337,405 | 12/1943 | Noel | 225/91 |

*Primary Examiner*—Douglas D. Watts
*Assistant Examiner*—John M. Husar
*Attorney, Agent, or Firm*—Jacques M. Dulin; Thomas C. Feix

[57] ABSTRACT

Curl management device for assisting in the uncurling and proper alignment of fax sheets on photocopier glass surfaces comprising a rigid sheet of plastic or other material (preferably not metal), having a weight on the order of from about 1 to about 5 ounces and a thickness of 1/16 to ⅛ inch and dimensions of approximately 8½ by 11 is disclosed. The plate has one or more specially configured cut-outs leading to an adjacent edge which permits viewing the edge of the fax sheet being held down and provides access for several fingers of the user to position the sheet properly with respect to the stop margins adjacent the edges of the photocopier glass. One or more holes or a notch in the cut-outs may be provided to permit hanging the plate next to the photocopier. One edge may be tapered to permit ease of tearing a continuous fax into individual sheets. One or more upturned ridges, handles or knobs may be provided to permit grasping for ease of manipulation of the plate. Space is provided on the plate for promotional information.

17 Claims, 1 Drawing Sheet

CURLED DOCUMENT MANAGEMENT DEVICE

FIELD

The field of this invention relates to devices for handling documents, and more particularly to a device for handling documents that are prone to curling, such as thin facsimile sheet material. Facsimile sheet material in order to be positioned on photocopier glass platens for reproduction purposes.

BACKGROUND

Within the past year the use of facsimile machines (faxes) has just exploded throughout the United States and the rest of the world. However, most of these fax machines are thermal type machines employing thin thermographic-type paper. The facsimile machine may or may not have facility for cutting each sequential page. Where it does not, and a fax transmission is multipage, the machine continues to deliver a single, long sheet which must be gathered, cut into single pages and then arranged in sequential order.

Another disadvantage of these machines is that the paper itself is not stable. For example, when fax paper is folded over onto its side, there will be a transfer of an image from one sheet onto another. Still further, the thermographic paper is so thin that it curls very easily. The paper is usually provided in rolls, and accordingly has a built in "set" or curl which, after feeding through the facsimile machine reasserts itself. Thus, a typical fax as received constitutes a number of pages of paper which curl, especially at each end. Then, over a period of time each sheet curls more and more until it winds itself up as a small tube.

Further, the thermographic paper and image is not stable. A fax left in sunlight, and to a lesser extent in florescent or incandescent light will fade or darken. Accordingly, a fax sheet is not adequate as a permanent record.

Accordingly, the current practice is to photocopy the facsimile after receipt, and the photocopy is then kept as the permanent record. This current practice is also done for a second reason; the thermographic paper is very hard on roller ball type pens because of the coating on the paper. The pen tip will be abraded very quickly if any attempt is made to edit a document on the fax paper. For these two reasons, faxes are commonly photocopied to provide both working copies and permanent record copies.

However, because of the curl problem described above, faxes are extremely difficult to photocopy. They do not feed easily or at all through copier machines, and accordingly they are usually manually copied. Because of the bright light from the photocopy machine, the user needs, for visual safety reasons, to lower the cover onto the fax sheet being copied. However, because the fax sheet is so light, it tends to move out of alignment with the slightest lid movement or breeze. Just lowering the lid of the photocopier is sufficient to disturb the fax sheet placed on the glass plate. In addition, because of the curl, in many instances the corner, or more, of the fax gets folded back. Both of these problems slow down the copying and cause many mistakes in copying with the attendant need to go back and recopy some or all of the pages of a given fax transmission.

In order to remove the curl from the fax sheet, one could attempt to roll the fax up in reverse orientation. However, the material is so thin that it is very hard to remove the curl from the upper and lower edges, and often times a crease is put in the fax itself. In addition, the handling can leave marks on the fax, such as skin oil smudges and the like. An alternative would be to draw the fax over an edge to impart a reverse curl. However, it is difficult to determine the precise amount of reverse curl in order to have the fax lay completely flat. It is also very difficult to remove the curl from the upper and lower ends of the fax sheet.

While it theoretically might be possible to place the fax sheet in a heavy press in order to remove the curl from the sheet, this is entirely impractical and as a fax transmission is a "RUSH" transmission which needs to be read and acted upon promptly. The amount of time required for the fax to be placed under the press would be far too long for the nature of the document. Further, if more then one page were put in the press simultaneously, then there would be transfer from one sheet to another. Likewise, if the press were other then heavy metal or other smooth white surface, and were instead a book, then there could be transfer of the ink from the book to the fax sheet.

Accordingly, there is no simple and effective method and apparatus for managing a curled or curling fax sheet or other document while it is being reproduced for review and/or archival purposes.

THE INVENTION

OBJECTS:

It is among the objects of this invention to provide a device for managing curled documents, more particularly for thermal fax sheets that have curled or are in the process of curling during reproduction on photocopy machines.

It is another object of this invention to provide a method for managing curled or curling documents for reproduction on photocopy machines.

It is another object of this invention to provide a simple sheet-like device having special holes and/or cut-outs therein for proper placement of a curled document in a flat position on the glass surface of a photocopy machine for reproduction purposes.

Still further other objects will be evident from the detailed description and drawings.

FIGURES

The invention is illustrated by reference to the drawings in which.

SUMMARY

Figure 1:
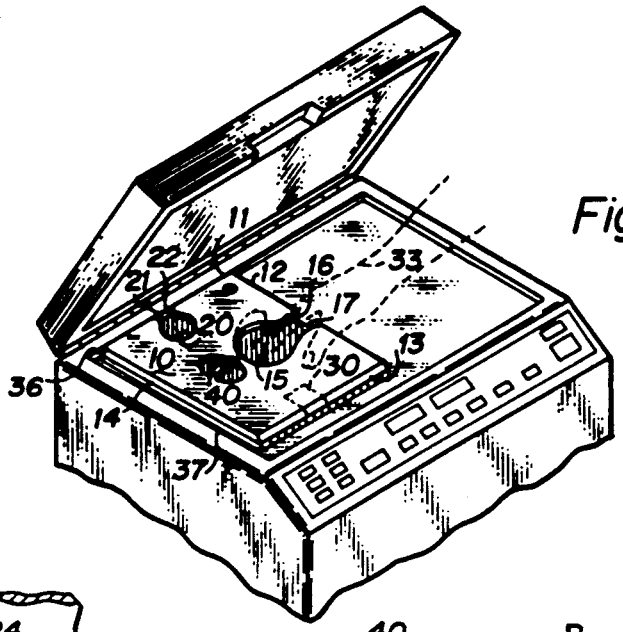
FIG. 1 is a perspective of one embodiment of the configured plate of this invention in use on a photocopy machine.

The invention comprises a unitary, configured, rigid plate with special cut-outs or holes therein which plate serves to assist in the uncurling and holding down of thin sheets of curled or curling paper material for purposes of photo-reproduction. While reference herein will be made to a sheet of fax paper, it is to be understood that any type of curled material such as blue prints, onion skin and the like may be managed with the specially configured curled sheet manager/hold-down plate of this invention.

The plate may have several holes therein which holes extend as cut outs to an adjacent margin. The holes are preferably relieved at two, or at least one, margin(s) of the plate. Preferably, the plate is in the order of 8 ½ inches wide by 11 inches long, but it may be somewhat more or less that size in dimension. For example, for A4 type paper, the plate may be somewhat longer and narrower. These cut-outs/holes permit the user to properly position the sheet underneath the hold down plate of this invention by moving it fractionally as required to abut the appropriate stops on the copier glass It is preferred to have two holes, one adjacent a short edge and the other adjacent a long edge so that proper X-Y adjustments can be made.

The plate is preferably made of a rigid plastic material, on the order of 1/16 to ⅛ inch thick and may be opaque or transparent. It is also preferable that the composition and surface of the plastic be such that it readily accepts printing for instructional or promotional purposes. It is also preferred that at least one of the two short edges be tapered so that a tearing edge is provided. In the alternative, the plate may be made of any rigid material such as cardboard, pasteboard or the like. While some light metal such as aluminum may be employed, it is not preferred to use steel as the opportunity to scratch or break the surface of the copier glass is to high. Further, the sheet should not be overly heavy as the function is not to act as a "press". Where the sheet weight is too high, it then becomes very difficult to adjust a sheet while on the copier glass. Thus, a sheet having a weight on the order of up to a few ounces is sufficient. Greater weight is a disadvantage, not only in handling but also in proper adjustment of the sheet being held down.

In contrast, a plate that is too flexible will not function properly as a hold-down for two reasons: First, the weight is not enough to overcome the curl. Second, it will not produce a straight tear because the hold-down plate will flex upwardly during the tearing motion. Under these considerations, I prefer a sheet of rigid plastic such as a polyolefin or polystyrene sheet having a thickness of 1/16 to ⅛ inch and having a weight in the order of 1 to 3 ounces.

It is also preferred that there be a hole provided in the plate to permit it being hung up next to the copier machine. In the alternative, the relieved hand access cut out can be provided with a notched portion to engage a wall hanger.

In another embodiment, one end of the hold-down plate is hinged under and to, or separately from, the copier lid, and can be secured to the copier lid at its opposite end to keep it out of the way when not needed, e.g. when copying non-curled documents or use with the automatic sheet feeder. For use with a curling fax sheet, the hold-down plate is disengaged and pivoted down over the fax. Then the lid is lowered and copying accomplished. The fax sheet is adjusted to the plate, not vice versa. This also minimizes hand adjustment of the fax sheet, and prevents misplacing the plate.

DETAILED DESCRIPTION OF THE BEST MODE

The following detailed description illustrates the invention by way of example, not by way of limitation of the principles of the invention. This description will clearly enable one skilled in the art to make and use the invention, and describes several embodiments, adaptations, variations, alternatives and uses of the invention, including what I presently believe is the best mode of carrying out the invention.

Referring now to FIG. 1, the hold down plate of this invention comprises a sheet 10 which is bounded by 4 margins 11, 12, 13 and 14 disposed at right angles with respect to each other to form a rectangular bounded hold down plate. Margins 11 and 13 form the short sides of the hold down plate which are typically 8½ inches wide, while margins 12 and 14 form the long sides which are typically 11 inches long.

Disposed inwardly of the margins is at least one cut-out area 15, 20, which also configured to have continue marginal edges 16 and 17 leading toward and joining at least one of the side margins. As shown, the cut-out 15 adjoins and is connected with the side margin 12.

A second cut-out 20 having side margins 21 and 22 which merge with the upper short side 11. It is important to note that the presence of these cut-outs changes the normal center of gravity of this unit from dead center to the lower left, the approximate spot marked by the cross, labeled CG. It could be understood that this is not the precise center, but shows the general CG location for consideration of proper location of a hole or a notch in the cut-out for hanging up the curl management plate of this invention.

Figure 2:
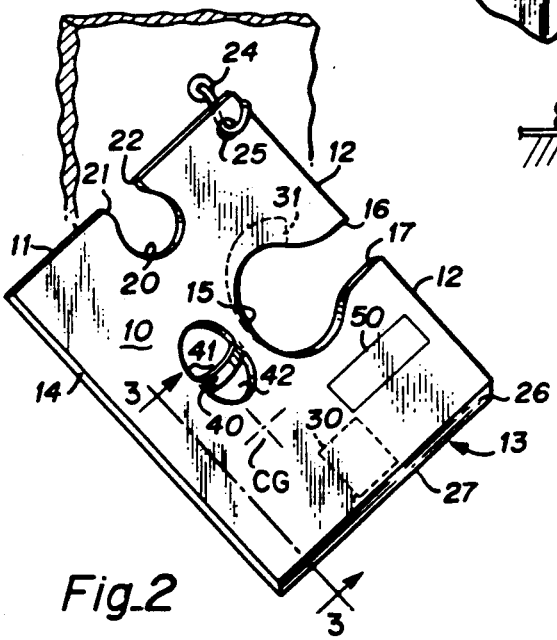
FIG. 2 shows the flattening plate of this invention in one storage position.

FIG. 2 shows the plate of this invention being hung on a suitable hook or peg 24 through hole 25. Preferably, the hook or peg is a small plastic hook with a wide base that has self-stick adhesive on the back thereof that is provided along with the curl management plate, of this invention as part of a kit. In the preferred embodiment, the plate, hook and instructions are packed in a poly bag.

Figure 3:
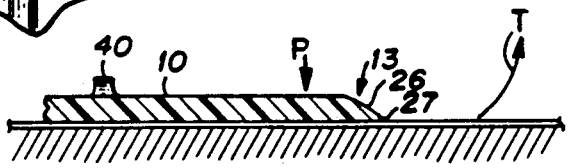
FIG. 3 shows a cross section of one edge that has been tapered to provide an edge for separation (tearing) of single sheets from a continuous print-out.

FIG. 3 shows in cross section the short marginal edge 11 or 13 of the curl management plate 10 of this invention having a taper 26 extending inwardly of the margin. This permits a relatively sharp and straight edge 27 for tearing off individual pages from a multi-page continuous fax print-out. Many faxes do not cut individual pages from a fax transmission. In some cases, with a relatively long transmission, the fax print out may be several yards long. The user then has to cut these individually. It is difficult to insert these in a standard cutter machine. Accordingly, by use of the curl management plate of this invention, it is simple task to lay the sheets out on some suitable countertop surface and tear them off one by one. Because of the relatively sharp edge formed by the tapered edge 27, the tear is clean.

In addition, some faxes that do have automatic cutting facilities often miss cutting off the fax identification transmission information. This is normally a small slip 8 ½ inches wide by about 1 ½ to 2 inches wide that normally should be trimmed at the very end of a transmission. However, often in single sheet transmissions, the machine will only cut after the transmission identification slip has been printed. For bookkeeping purposes these slips need to be cut off and handled separately. Accordingly, the cut off edge 27 of the curl management plate permits neatly tearing off these ID/confirmation slips.

Figure 4:
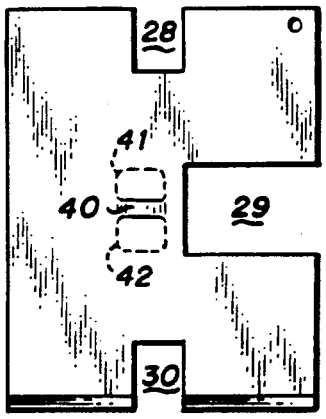
FIG. 4 shows another embodiment in plan view with different cut-outs for ease of handling the fax sheets to position them when under the plate of this invention.

FIG. 4 shows configurations of alternative cut-outs 28, 29, 30. Cut out 30 is shown in dashed lines in FIGS. 1 and 2 as not extending to marginal edge 13. Note in FIGS. 1, 2 and 5 the hook portion 31 in the upper margin of the side opening cut-out 15. This specially configured cut-out portion permits hanging on a hook 24 or peg without the need of a hole such as hole 25.

Figure 5:
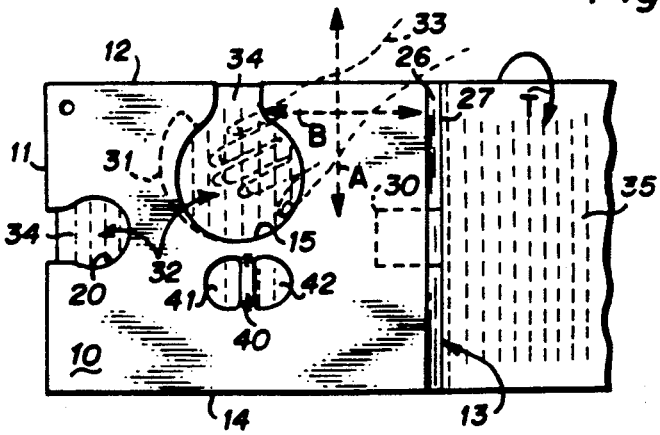
FIG. 5 shows in plan view tearing and positioning of fax sheets.

FIGS. 1 and 5 show the purpose of the wider "head" area 32 of the cut-outs 15, 20. In that figure, the hand 33 of the user is able to move the sheet underneath the curl management plate by contact with the back of the fax sheet 34 in the area of the cut-out head portion 32 The cut-out head portion is wider than a 2 or 3 finger touch area so that the fax sheet may be moved appropriately (see dashed, crossed arrows A, B in FIG. 5) to line it up properly with the stops 36, 37 adjacent the edges of the surface of the copier glass 38. Also note that the smaller cutout 20 which inlets from the short side margin 11 permits adjustment at right angles to the larger cut-out 15 contiguous with the side margin 12.

Another feature of this invention is the provision for the cut-outs being inlet from or contiguous with the side margins 11, 12, 13 or 14 as the case may be. This permits one to see the edge of the sheet in order to gage the proper placement on the copier glass. This is particularly useful where the curl management plate is opaque.

Still another feature is shown in all FIGS. by the provision of raised loop or ridge 40 which functions as a graspable handle that permits easily picking up the flat plate 10 when it is laid down on the copier glass. Apertures 41, 42 are optionally associated with the handle 40.

Further, in cases where the curling sheet picks up static, it is possible to dissipate this static by applying a metal foil sheet 45 (not shown) to one or both surfaces (top or bottom) of the curl management plate 10. A preferred material is adhesive backed aluminum foil which may cover the entire sheet or be applied in strips. This effectively dissipates the static and permits better sheet management.

It should be understood that various modifications within the scope of this invention can be made by one of ordinary skill in the art without departing from the spirit thereof. I therefore wish my invention to be defined by the scope of the appended claims as broadly as the prior art will permit, and in view of the specification if need be.

I claim:

1. A curling sheet management device for use in assisting in flattening thin sheets of paper such as fax transmissions which have a tendency to curl, comprising in operative combination:

a) a plate generally rectangular in configuration having two short side margins and two longer side margins disposed at right angles thereto;

b) said plate comprises a rigid flat piece of material having a thickness sufficient to provide enough weight to hold down thin curling sheet material, while having sufficient rigidity to permit one edge to be used as a tearing guide for said thin sheet material;

c) at least one relieved portion in said plate, said relieved portion having at least one marginal edge leading to at least one of the edges of said plate;

d) said relieved portion having a sufficient area extent to permit the placement of at least two fingers of a user so that said user can move said thin sheet material under said plate while being held down by said plate to properly align it with stops on a photocopying machine;

e) whereby said plate permits holding down said thin sheet material, while preventing it from curling, and permitting adjustment of the positioning of said sheet for accurate photocopying.

2. A curling sheet management device as in claim 1 wherein:

a) there are at least two relieved portions.

3. A curling sheet management device as in claim 2 wherein:

a) one relieved portion is smaller than another.

4. A curling sheet management device as in claim 2 wherein:

a) at least one of said relieved portions marginal edges does not lead to an edge of said plate.

5. A curling sheet management device as in claim 1 which includes:

a) means for hanging up said plate.

6. A curling sheet management device as in claim 5 wherein:

a) said hang-up means is a hole spaced from the edges of said plate disposed so that the center of gravity of said plate is spaced therebelow.

7. A curling sheet management device as in claim 5 wherein:

a) said hang-up means is a notch in said relieved portion marginal edge.

8. A curling sheet management device as in claim 1 which includes:

a) means for grasping said plate.

9. A curling sheet management device as in claim 8 wherein:

a) said grasping means is a handle.

10. A curling sheet management device as in claim 9 wherein:

a) said handle comprises a graspable ridge or lip extending above a surface of said plate.

11. A curling sheet management device as in claim 1 wherein:

a) at least one of said short side margins is tapered to provide a cut-off edge.

12. A curling sheet management device as in claim 11 wherein:

a) both said side margins are tapered.

13. A curling sheet management device as in claim 1 which includes:

a) indicia disposed on a face of said plate providing information for the user selected from instructions and promotional material.

14. A curling sheet management device as in claim 1 wherein:

a) there are at least two relieved portions, one of which is smaller than the other;

b) at least one of said short side margins is tapered to provide a cut-off edge; and which includes:

c) means for hanging up said plate;

d) a handle for grasping said plate; and e) indicia disposed on a face of said plate providing information for the user selected from instruction and promotional material.

15. A curling sheet management device as in claim 14 wherein:

a) said hang-up means is a hole spaced from the edges of said plate disposed so that the center of gravity of said plate is spaced therebelow.

16. A curling sheet management device as in claim 14 wherein:

a) said hang-up means is a notch in said relieved portion marginal edge.

17. A curling sheet management device as in claim 14 wherein:

a) both said side margins are tapered.

* * * * *